US006328238B1

(12) United States Patent
Chism

(10) Patent No.: US 6,328,238 B1
(45) Date of Patent: Dec. 11, 2001

(54) CABLE PAY-OUT TUBE

(75) Inventor: Camille A. Chism, Omaha, NE (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/428,736

(22) Filed: Oct. 28, 1999

(51) Int. Cl.[7] ..... B65H 57/12; B65H 55/00
(52) U.S. Cl. ..... 242/171; 242/157 R; 242/615.3
(58) Field of Search ..... 242/157 R, 171, 242/163, 615.3

(56) References Cited

U.S. PATENT DOCUMENTS

| | | | | |
|---|---|---|---|---|
| 4,009,845 | * | 3/1977 | Santucci et al. | 242/129.7 |
| 4,274,607 | * | 6/1981 | Priest | 242/163 |
| 5,150,852 | * | 9/1992 | Hunt et al. | 242/157 R |
| 5,520,347 | * | 5/1996 | Bass et al. | 242/157 R |
| 5,810,272 | * | 9/1998 | Wallace et al. | 242/157 R |
| 5,979,811 | * | 11/1999 | Bass et al. | 242/157 R |

* cited by examiner

*Primary Examiner*—Michael R. Mansen
(74) *Attorney, Agent, or Firm*—Thomas, Kayden, Horstemeyer & Risley, LLP

(57) ABSTRACT

A pay-out tube for container-packed coiled wire or cable in which the tube in use has a cable entrance end within the container and a cable exit end on the container exterior. The tube has a flange thereon adjacent the cable exit end and passes through a hole or opening in the wall of the container. The tube has a plurality of latching fingers extending from adjacent the exit end toward the entrance end and a flange adjacent the exit end. Each of the latching fingers has a camming surface and a carton wall engaging lip. The camming surface is so located that when the tube is inserted in the opening in the carton wall and moved longitudinally, the edge of the opening bears against the camming surface to force the latching arm toward the axial center of the tube to allow the tube to be passed through the opening. Each lip is spaced from the flange a distance approximately equal to the carton wall thickness so that when the flange engages the wall, the latching fingers are free of the edge of the opening and spring back to their original position, thus affixing the tube to the carton wall.

7 Claims, 4 Drawing Sheets

CABLE PAY-OUT TUBE

FIELD OF THE INVENTION

This invention relates to arrangements for dispensing wire, cable, and the like from the containers in which it is coiled, and, more particularly, to a pay-out tube disposed within the container and communicating through a wall thereof to the exterior, through which the wire, cable, or the like is passed. This invention is related to that shown in U.S. patent application Ser. No. 09/102,329, filed Jun. 22, 1998 (Bass et al. 4-2), now U.S. Pat. No. 5,979,811 the disclosure of which is incorporated herein by reference.

BACKGROUND OF THE INVENTION

It is the current practice in packaging insulated communication wire or cable in a carton to coil the wire in a FIG. 8 configuration of the coil which is used to reduce twisting of the wire as it is coiled, thereby reducing a tendency of the wire to kink as it is pulled from the carton, generally through an opening in a side wall thereof. The pulling process is facilitated by the installation of a pay-out tube which extends into the interior of the carton, and which is affixed to a wall thereof in a suitable manner so as, generally, to have a stub portion extending outside of the carton. In U.S. Pat. No. 5,152,476 of Moser, there is shown a preferred arrangement for affixing the tube to the wall of the carton having a modified bayonet lock type of action. Numerous prior art arrangements utilize this arrangement, or modifications thereof, for mounting the tube. Generally, such arrangements require that the tube be mounted from inside the carton and twisted to engage the bayonet lock. This operation is difficult to perform by hand, especially when the carton is full, as it usually is, since the pay-out tube generally cannot be installed until after the cable is placed in the carton.

Most tubes in use today are in the form of hollow elongated cylinders with the ends thereof being radiused between the outer and inner walls to eliminate sharp corners over which the wire passes as it is pulled through the tube. Such radiused ends are shown in U.S. Pat. Nos. 5,064,136 and 5,115,995 of Hunt. In these arrangements, the entrance end surface substantially conforms to a hemi-toroidal surface having a faired joinder at its inner and outer margins with the inner and outer walls of the tube. Such a rounded surface imposes a lower limit on the bend radius of the wire being pulled through the tube, which however, does not prevent kinking of the wire or damage to its insulation when the wire is being pulled from layers immediately adjacent to the tube and lying between the end of the tube and the wall in which the tube is mounted. In that case, the wire undergoes a sharp reverse bend as it enters the tube, and the radiused end of the tube is insufficient to prevent kinking and possible damage.

The aforementioned Moser patent discloses an end cap for the entrance end of the pay-out tube which greatly increases the minimum possible radius of curvature of the wire, thereby materially reducing the tendency of the wire to kink even in the extreme reverse bend case discussed in the foregoing.

However, any cap arrangement for the pay-out tube gives rise to the additional problem of the introduction of a separate part, with the possibility of its being lost or mislaid. Also, the fabrication of such a separate part requires additional molds and fabrication steps, thereby increasing the cost of the pay-out tube assembly. Moser apparently recognizes the problem at least to some extent, by suggesting that the cap and the pay-out tube may be fused together to produce a single unitary structure, but apparently the two parts are intended to be fabricated separately and then joined, with a consequent two molding operations, hence, an increase in production costs.

In U.S. Pat. No. 5,520,347 of Bass et al. there is disclosed a one-piece pay-out tube which overcomes the aforementioned disadvantages of the Moser device as well as many other prior art devices. The Bass et al (hereinafter "Bass") pay-out tube has a flange at the cable entrance end thereof which has a radiused surface, the radius being greater than the kinking radius $R_c$, and a central opening where the radiused surface fairs into the inner wall of the tube, with the inner wall being tangential to the radiused surface. The opposite or cable exit end of the tube has a mounting arrangement which is strengthened by suitable ribs and strength members, which are cast or formed integral with the remainder of the tube. The Bass patent is incorporated herein by reference.

In use, a pay-out tube functions to guide wire or cable out of the carton in, preferably, an unkinked condition, with a reasonable ease of pay-out. However, it is seldom the case that all of the wire contained in a carton is payed out at one time, i.e., in a single operation, and usually, after the desired length of cable has been pulled out, the cable is cut. When this occurs, the cable, which has been under tension, tends to spring back into the carton where it becomes inaccessible in the extreme case. Numerous arrangements have been used to prevent the cable from thus springing back, and for holding it fixed within the tube. One arrangement common in the prior art and shown in the Bass patent is a resilient diaphragm formed of wedge-shaped fingers adjacent the cable entrance end of the tube. The fingers are resilient enough to yield to the cable as it is pulled out under tension, but sufficiently stiff enough to resist the tendency for the cable to spring back after being cut, thereby holding the cable in place provided the spring back action is not to strong. U.S. Pat. Nos. 5,152,476 of Moser, 5,064,136 of Hunt and 4,274,607 of Priest all show such diaphragm arrangements. Provided wire or cable tension is not excessive, such diaphragms perform adequately, but, as is the usual case, being integrally formed with the tube, they require complex mold designs which materially increase costs. In the aforementioned pending Bass et al. patent application, the diaphragm arrangement is dispensed with in favor of tapered compartments on the inner walls of the tube which receive the end of the cable and prevent it from springing back into the carton. In addition to being a single molded member, and, hence, economical to manufacture, this arrangement is especially effective with stiff cables, more so than the diaphragm arrangement.

In virtually all of the foregoing prior art pay-out tubes, some form of bayonet lock or latch is used to anchor the tube in place in the carton. As pointed out hereinbefore, mounting such a tube within the carton requires inserting the tube into an exit hole in the carton from within the carton, and then twisting the tube to lock it in place.

What is needed, therefore is a pay-out tube of, preferably, one piece molded construction, that does not require any twisting action to lock it in place, being mountable to the carton with a simple axial movement.

SUMMARY OF THE INVENTION

The present invention is a pay-out tube for use with boxed wire or cable, usually wound in a FIG. 8 configuration, which achieves the foregoing desiderata. Henceforth the term "cable" will be used in a generic sense to include cable, wire, or other filamentary material.

In a first illustrative embodiment of the invention the pay-out tube is a tubular member having a cable entrance end and a cable exit end, being tapered from a first inner diameter at the cable entrance end in the range of two and one quarter to three inches (2.25"–3.00") to a second inner diameter at the cable exit end of approximately two and three quarter inches to three and one-half inches (2.75"–3.50"). In other words, the inner diameter increases from entrance end to exit end by approximately one-half an inch (0.5"). The inside edge of the tube at the cable entrance end is radiused and faired into the interior tube wall to facilitate passage of the cable into the tube without abrasive damage, and to prevent kinking. The dimensions given are in the range of those most commonly used; however, it is to be understood that other dimensions may characterize the interior and exterior of the tube, depending upon the type of cable being paid out. Adjacent the exit end of the tube is a flange of greater diameter than the maximum exterior diameter or O.D. which, as will be apparent hereinafter, functions as an axial locator of the tube by bearing against the wall of the carton.

In accordance with the invention, the flange is supported and affixed to the tube by two or more fingers in a circular array, which are formed by longitudinal slots in the tube. Interspersed between pairs of support fingers are cantilevered latching fingers, there being at least two and preferably more such latching fingers in a circular array. Both the support fingers and the latching fingers extend beyond the flange to the exit end of the tube. Each of the latching fingers has, at its distal end, a sloped camming surface having an upper carton wall engaging lip. The lip is spaced from the flange a distance approximately equal to the thickness of the carton wall.

The tube of the invention is mounted to the carton by the exit end being pushed through a pre-cut hole in the carton from the inside thereof. As the tube is pushed axially into the hole, the edges of the hole cam the distal ends of the latching fingers toward the axis of the tube by bearing against the canming surface. Approximately simultaneous with the flange coming to bear against the interior of the carton wall, the ends of the latching fingers are freed from the hole edge and snap back to their original position, with the lips bearing against the exterior of the carton wall, thereby anchoring the tube in place, without its having to be twisted.

In a second, and preferred, embodiment of the invention, the tube is insertable into the carton from the outside. In this embodiment, the cantilevered latching fingers have their distal ends spaced from the surface of the flange which bears against the outside of the wall of the carton, with the camming surfaces inclinded upward toward the flange and with the lips spaced from the flange a distance approximately to the thickness of the wall. Installation of the pay-out tube involves inserting the cable input end into the pre-cut hole in the carton wall and moving it axially into the carton. The edge of the hole cams the latching fingers toward the axis until the flange bears against the outer surface of the carton wall at which position the latching fingers snap back to their original position with the wall gripped between the lips or the interior and the flange on the exterior, thereby fixing the tube in place without any twist having been necessary. This embodiment of the invention is of particular utility in that it does not require any invasion of the carton interior to affix the pay-out tube. Thus, the carton may remain closed until such time as pay-out begins, when it becomes necessary to pass the end of the cable through the tube.

In both embodiments, the tapered hollow compartments of the Bass et al. application may be used to insure that the cable end does not spring back.

The pay-out tube in its entirety is a single molded member of, preferably, a resilient plastic, although a relatively stiff plastic material may be used, provided there is sufficient resiliency of the latching fingers to allow them to be cammed inwardly and to spring back to their original position.

The features and advantages of the present invention will be more readily apparent from the following detailed description, read in conjunction with the accompanying drawings.

DETAILED DESCRIPTION

Figure 1:
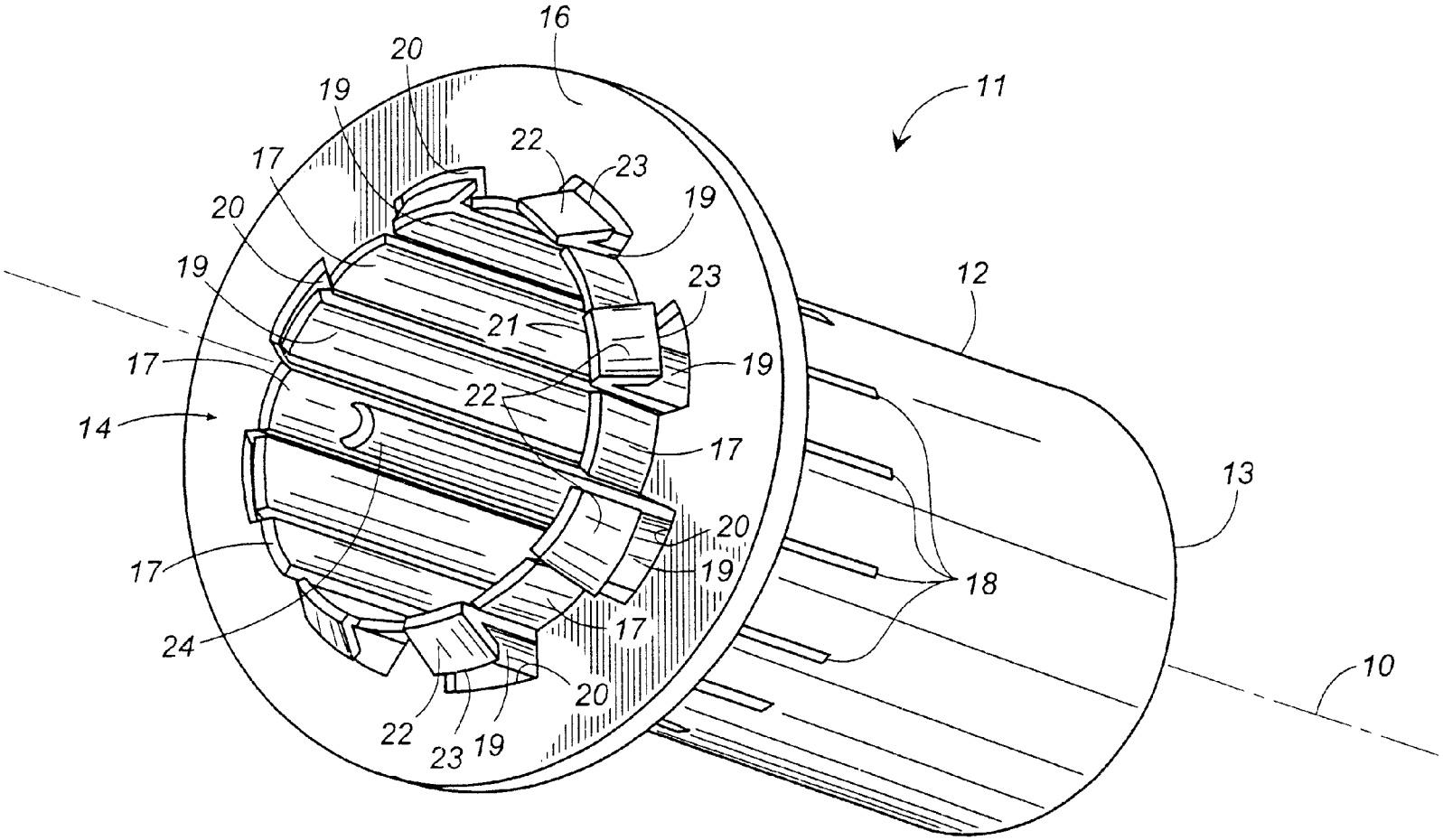
FIG. 1 is a perspective view of a first illustrative embodiment of the pay-out tube of the invention.

In FIG. 1 there is shown, in perspective, a first embodiment 11 of the pay-out tube of the invention. Tube 11 comprises an elongated body portion 12 having a longitudinal axis 10 and having a cable entrance end 13 into which an end of the cable in the carton, not shown, to which tube 11 is to be attached is inserted for pay-out through the tube 11 and out a cable exit end 14. Mounted on body 12, and preferably integral therewith, is a flange 16 adjacent the cable exit end 14. The flange 16 is supported by a plurality of support members or fingers 17 in a circular array, formed by slits 18 in body portion 12, and which extend beyond flange 16, as shown. Flange 16 has a plurality of openings 20 through which fingers 19 pass to accommodate the latches on each of fingers 19. The array of support fingers 17 is coaxial with a circular array of latching fingers 19, with the fingers 17 and 19 alternating, as shown. The distal end 21 of each of the latching fingers 19 has formed thereon a camming surface 22 which slopes backward and upward toward the flange 16, terminating in a carton engaging lip 23 spaced from the flange surface a distance approximately equal to the thickness of the carton wall onto which the tube 11 is to be affixed. This thickness may be the thickness of the cardboard or other material forming the carton, or, as is often the case, it will be a double thickness where the wall is formed of more than one layer or ply. Within the tube may be one or more hollow tapered compartments 24 for holding the cable end, as taught in the aforementioned Bass et al. patent application. In addition, the interior of the tube is preferably tapered from a lesser inner diameter at the cable entrance end to a greater inner diameter at the cable exit end, also as taught in the Bass et al. patent application.

The pay-out tube in its entirety is a single molded member and does not require an intricate mold structure such as is usually necessary where a diaphragm arrangement is used. However, as will be made clear hereinafter, the principles and features of the invention are applicable to other forms of pay-out tubes which may include a diaphragm or other means for holding the cable end.

Figure 2:
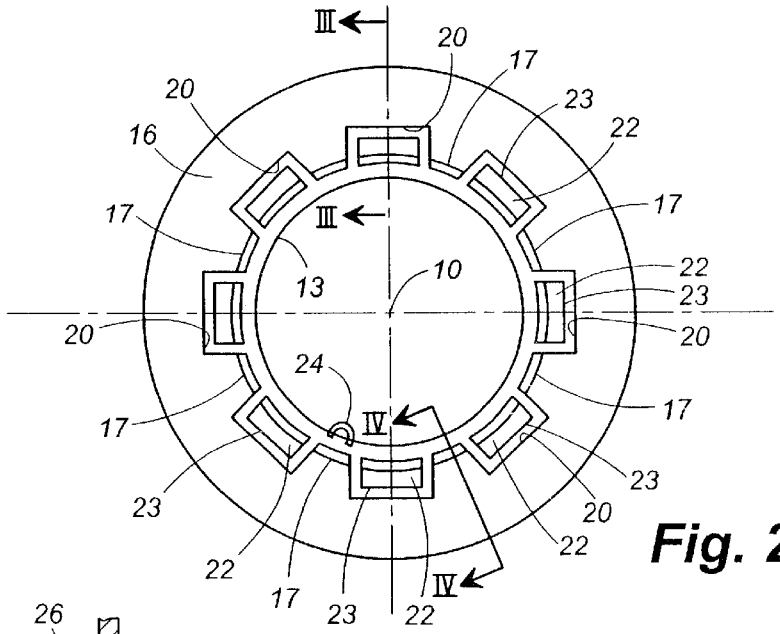
FIG. 2 is a front elevation view of the pay-out tube of FIG. 1.
Figure 3:
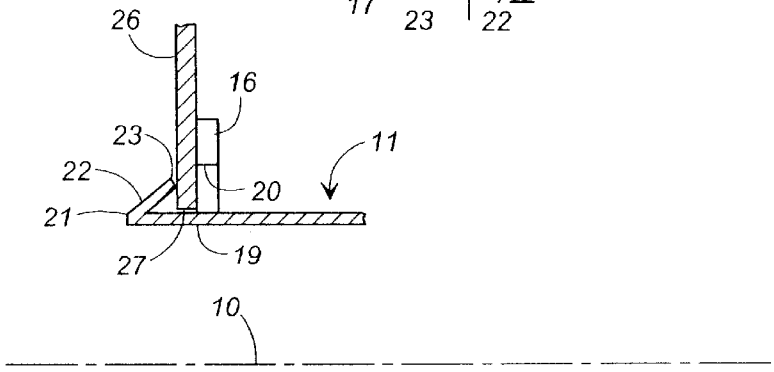
FIG. 3 is a partial cross-sectional view along the line III—III of FIG. 2.
Figure 4:
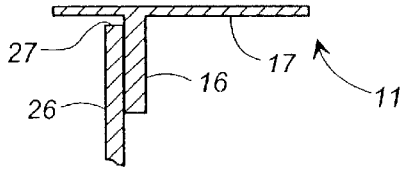
FIG. 4 is a partial cross-sectional view along the line IV—IV of FIG. 2.

These principles and features of the present invention will be made more clear by reference to FIGS. 2 through 5. FIG. 2 is an elevation view of the cable exit end 14 of the tube 11, which is designed for mounting to the carton from the inside thereof. As can be seen, the support fingers 17 and the latching fingers 19 alternate in a circular array about axis 10, and flange 16 extends well beyond the array. In the sectional view of FIG. 3, a wall 26 of the carton having a hole 27 therein for receiving the tube 11, is shown. FIG. 3 illustrates the latched position for tube 11, with tube 11 situated within hole 20 and flange 16 bearing against the interior surface of wall 26, while each of the lips 23 bears against the outer surface of wall 26. The tube 11 is thus anchored firmly in place. FIG. 4 illustrates how flange 16, shown to be integral with fingers 17, bears against wall 26, functioning both as a latching element against which lips 23 hold wall 26, but also as a longitudinal or axial locator.

Figure 5:
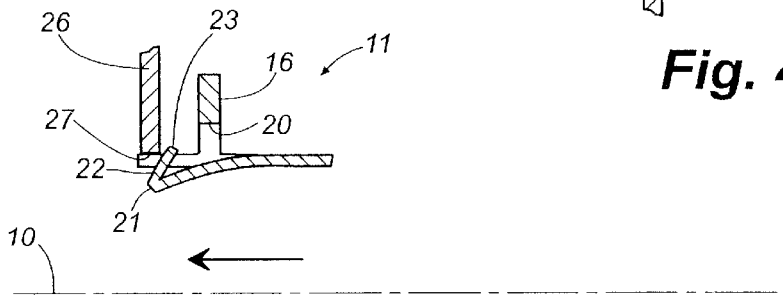
FIG. 5 is a partial cross-sectional view depicting the action of a latching finger of the invention during insertion.

FIG. 5 illustrates how the edge of hole 27 in wall 26 bears against camming surface 22 as tube 11 is pushed in the direction of the arrow, and cams fingers 19 inwardly toward the axis 10 of tube 11, allowing the distal ends 21 of the latching fingers 19 to pass through hole 27. It is to be understood that, in this embodiment, the direction of the arrow is from the interior to the exterior of the carton containing the cable. As the tube 11 is pushed further in the direction of the arrow, flange 16 comes to bear against wall 26, and latching fingers 19 spring back to their original configuration, as shown in FIG. 3, thereby affixing tube 11 to the carton in its operative position.

The embodiment depicted in FIGS. 1 through 5 possess the features and principles of the present invention, as explained in the foregoing. However, it is still necessary to invade the carton interior to insert the tube 11 into its fixed operative position.

Figure 6:
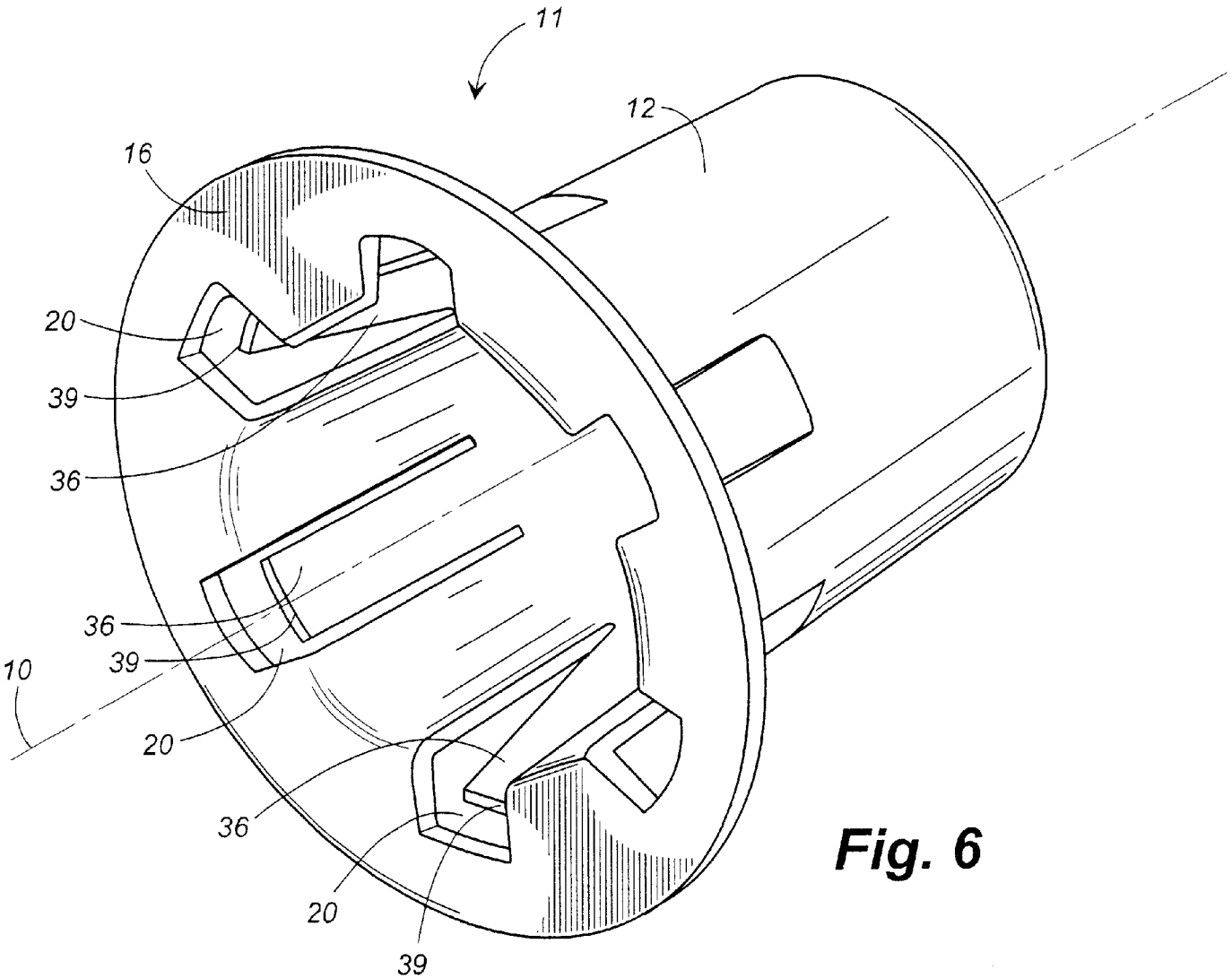
FIG. 6 is a perspective view of a second illustrative embodiment of the pay-out tube of the invention.
Figure 7:
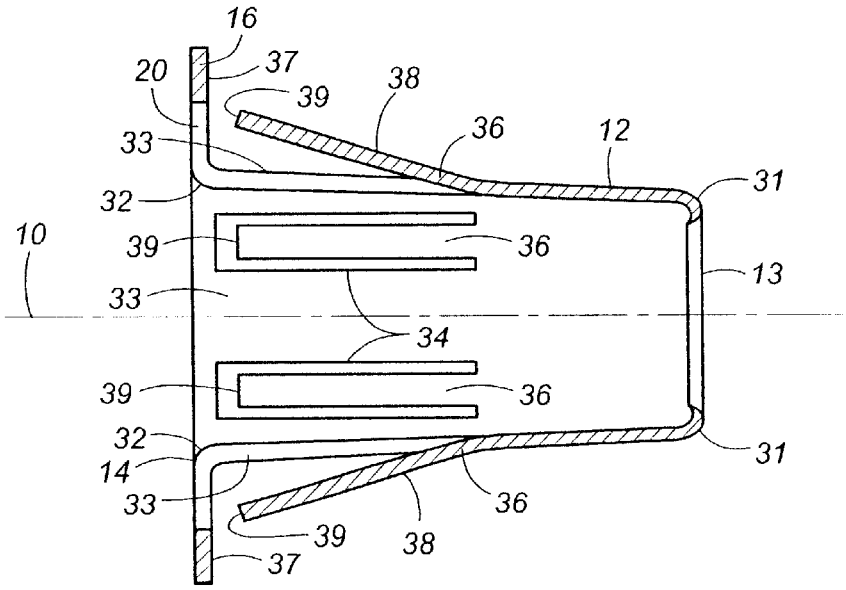
FIG. 7 is a partial cross-sectional elevation view of the pay-out tube of the invention shown in FIG. 6.

In FIGS. 6 through 9 there is shown a preferred embodiment of the invention wherein the tube 11 is insertable into the carton from the exterior thereof. In this embodiment, as shown in the figures, like parts bear the same numerical designation as corresponding parts in FIGS. 1 through 5. Thus, tube 11 has an elongated body portion 12 having a cable entrance end 13 and a cable exit end 14. Likewise, a flange 16 is mounted to or integral with the body portion 12 at the exit end 14 thereof. As best seen in FIG. 7, entrance end 13 has a toroidal shaped surface 31 to reduce wear and too sharp bending of the cable passing into and through the tube 11. The intersertion of flange 16 with body 12 at the exit end 14 likewise has a curved surface 32 for facilitating passage of the cable out the exit end 14. Body portion 12 is preferably tapered from a large diameter at the exit end, for example, approximately two and three-quarters inches (2¾"), to a smaller diameter, for example, approximately two and one-half inches (2½") at cable entrance end 13. This taper facilitates insertion of the tube 11 into and through the opening 27 in carton wall 26 during attachment of the tube 11 to the carton. The taper also allows stacking of the pay-out tubes for shipping. Although not shown, tube 11 may have one or more hollow tapered compartments 24 on the interior wall thereof in the same manner or shown in FIGS. 1 and 2.

A plurality of support fingers 33, formed by slits 34 in the body portion 12 of tube 11 support the flange 16 at the exit end 14 as best seen in FIG. 6. These fingers 33, unlike fingers 17 in the embodiment shown in FIGS. 1 through 5, preferably do not extend beyond the outer surface of flange 16. Slits 34 also form a plurality of latching fingers 36 which slope outwardly and upwardly from body portion 12 toward the inner surface 37 of flange 16, as best seen in FIGS. 6 and 7. The top surface of each of fingers 36 is a camming surface, and each of fingers 36 ends in a carton engaging lip 39 which is spaced from flange surface 37 a distance approximately equal to the thickness of wall 26 of the carton.

Figure 8:
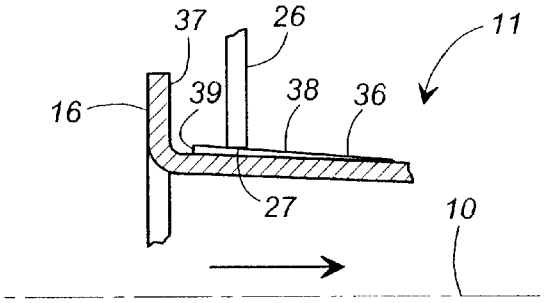
FIG. 8 is a partial cross-sectional view depicting the action of a latching finger of the invention during insertion of the pay-out tube into the carton.
Figure 9:
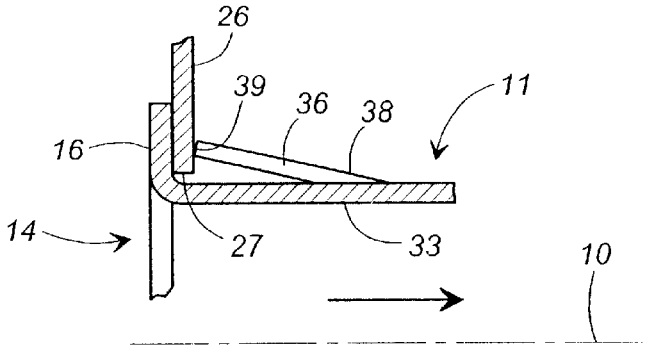
FIG. 9 is a partial cross-sectional view depicting the manner in which the pay-out tube of the invention is affixed to a carton.

FIGS. 8 and 9 illustrate the latching action of the fingers 36 during mounting of tube 11 onto the carton. In FIG. 8, as the tube 11 is pushed through hole 27 in the carton in the direction of the arrow, the edge of hole 27 bears upon camming surface 38 of arm 36 and forces it down toward the axis 10. When surface 37 comes to bear against the exterior of wall 26, arms 36 are relieved of the pressure from the edge of hole 27, and they snap back to their original position, with the lips 39 bearing against the inside surface of wall 26, as best seen in FIG. 9.

In the embodiment shown in FIGS. 6 through 9, the pay-out tube 11 is mountable on the carton without the necessity of opening the carton or twisting the tube 11 to lock it in place. The tube 11 is configured such that it is easily moldable as a single piece, thereby being both easy to make and simple to install. Further, there are no extra parts that can be lost or misplaced, and, with hollow, tapered compartments 24 therein, cable spring-back is readily preventable.

In conclusion it should be noted that it will be obvious to those skilled in the art that many variations and modifications may be made to the present preferred embodiment or embodiments without departure from the principles of the present invention. All such variations and modifications are intended to be included herein as being within the scope of the present invention. Further, in the claims hereafter, the corresponding structure, materials, acts, and equivalents of all means or step plus function elements are intended to include any structure, materials or acts, for performing the functions with other specifically claimed elements.

What is claimed is:

1. A pay-out tube for use with container-packaged coil cable, wherein a carton has a wall with an opening therein for receiving said pay-out tube, said pay-out tube comprising:

an elongated tubular body having a central axis and having a cable entrance end and a cable exit end;

a continuous flange on said body adjacent said cable exit end, said flange having a first surface adapted to bear against a carton wall when said pay-out tube is mounted in the carton and a second surface;

two or more latching fingers extending longitudinally from a portion of said tubular body intermediate said cable entrance end and said cable exit end toward said cable exit end adjacent said continuous flange, each of said fingers having a free distal end disposed between said cable entrance end and said first surface;

each of said latching fingers having a camming surface thereon positioned to be engaged by the edge of the opening in the carton wall and cammed toward said central axis when said tube is inserted into the carton; and each of said latching fingers having a carton wall engaging lip spaced from said flange a distance approximately equal to the thickness of the carton wall.

2. A pay-out tube as claimed in claim 1, and further including a plurality of support fingers for supporting said flange on said tubular body adjacent the cable exit end thereof.

3. A pay-out tube as claimed in claim 2 wherein said support fingers are arranged in a circular array around said central axis.

4. A pay-out tube as claimed in claim 3 wherein said latching fingers and said support fingers alternate around the circumference of said tubular body.

5. A pay-out tube as claimed in claim 1 wherein said lip on each of said latching fingers is spaced from said first surface a distance approximately equal to the thickness of the carton wall.

6. A pay-out tube as claimed in claim 5 wherein said camming surface on each of said latching fingers slopes away from said central axis toward said first surface of said flange.

7. A pay-out tube as claimed in claim 1 wherein said camming surface of each of said latching fingers slopes upwardly away from said central axis toward said first surface from said tubular body intermediate said cable entrance end and said first surface.

* * * * *